US007798050B2

(12) United States Patent
Sembtner

(10) Patent No.: US 7,798,050 B2
(45) Date of Patent: Sep. 21, 2010

(54) QUICK-RESPONSE DRIVE MECHANISM FOR CONTROLLING THE MOVEMENT OF AN OBJECT RELATIVE TO A SUPPORT

(75) Inventor: Roger Sembtner, Fellbach (DE)

(73) Assignee: Moog GmbH (DE)

( * ) Notice: Subject to any disclaimer, the term of this patent is extended or adjusted under 35 U.S.C. 154(b) by 385 days.

(21) Appl. No.: 11/977,535

(22) Filed: Oct. 24, 2007

(65) Prior Publication Data

US 2008/0264246 A1 Oct. 30, 2008

(30) Foreign Application Priority Data

Oct. 26, 2006 (DE) ..... 10 2006 050 604

(51) Int. Cl.
*F41G 5/02* (2006.01)

(52) U.S. Cl. ..... 89/41.15; 89/41.02

(58) Field of Classification Search ..... 89/41.02, 89/41.15

See application file for complete search history.

(56) References Cited

U.S. PATENT DOCUMENTS

| | | | | | |
|---|---|---|---|---|---|
| 1,881,011 | A | * | 10/1932 | Wittkuhns | 318/80 |
| 1,987,438 | A | * | 1/1935 | French | 362/371 |
| 2,021,720 | A | * | 11/1935 | French | 362/386 |
| 3,732,412 | A | * | 5/1973 | Tyroler | 362/293 |
| 5,673,989 | A | * | 10/1997 | Gohl et al. | 362/35 |
| 2003/0177897 | A1 | | 9/2003 | Bar | |

FOREIGN PATENT DOCUMENTS

| | | | |
|---|---|---|---|
| DE | 454793 | C | 9/1925 |
| DE | 37 36 262 | A1 | 5/1989 |
| EP | 1 096 218 | B1 | 5/2001 |
| EP | 1333240 | A2 | 8/2003 |
| FR | 9 82 021 | A | 1/1951 |
| FR | 982 021 | A | 1/1951 |
| GB | 574007 | A | 12/1945 |
| GB | 700315 | A | 11/1951 |

* cited by examiner

*Primary Examiner*—Stephen M Johnson
(74) *Attorney, Agent, or Firm*—Phillips Lytle LLP

(57) ABSTRACT

An improved drive mechanism (100) adapted to be mounted on a support for controllably moving a first output shaft (16) about either or both of two orthogonal axes (T, E). The drive mechanism has a stationary lower portion adapted to be mounted on the support and having a movable upper portion mounted for movement relative to the stationary portion. The improved drive mechanism broadly includes: a first power train (10, 12, 2, 4, 14) for controllably rotating a first gear (6); a second power train (9, 11, 1, 3,13) for controllably rotating a second gear (5); and a third gear (7) connected to the first output shaft and meshing with at least one of the first and second gears. The first, second and third gears form a portion of a differential-like mechanism (18) mechanically coupling the first and second power trains to the first output shaft. The first and second power trains may be selectively operated to controllably and cooperatively move the first output shaft to a desired position relative to the support.

18 Claims, 3 Drawing Sheets

QUICK-RESPONSE DRIVE MECHANISM FOR CONTROLLING THE MOVEMENT OF AN OBJECT RELATIVE TO A SUPPORT

TECHNICAL FIELD

The present invention relates generally to a quick-response drive mechanism for controlling the movement of an object relative to a support, and, more particularly, to an improved drive mechanism for quickly aiming a weapon relative to a support upon which it is mounted about elevation and azimuth axes toward an incoming projectile.

BACKGROUND ART

In order to meet the requirements for low weight, high mobility and air transportability in conjunction with high protection, military vehicles in the future will be equipped with active protection systems instead of more and more heavy armor.

Such active protection systems are especially designed for the defense of military vehicles against guided missiles, ammunition fired from heavy guns and artillery, and rocket propelled grenades (RPG). Incoming missiles or projectiles will be detected and tracked by a fast-reacting sensor suite having a suitable search and tracking radar, and finally destroyed close to the vehicle by an appropriate counter-fire, such as from a Gatling gun, a fragmentation grenade, or the like. In order to do this, a defense grenade might, for example, be fired from a lightweight launcher that can be aimed extremely quickly in the direction of the incoming projectile. The act of aiming the launcher involves changes in elevation (height axis) and traverse (side axis) to direct the launcher toward the incoming projectile. After being fired, the grenade is exploded in the vicinity of the projectile so that the projectile is neutralized a safe distance away from the vehicle.

For example, RPGs can be fired at military vehicles from short combat distances of less than 100 meters. Hence, active protection systems must have a quick reaction time and the highest dynamics. After target detection, the drive mechanism of the active protection system must be capable of aiming the launcher at the incoming projectile in fractions of a second (i.e., in milliseconds).

In order to facilitate this, the mass and inertia of the movable portion of the launcher must be minimized, and the power available to move the launcher from an initial position to an aimed position must be maximized.

The typical configuration of the aiming drive of the launcher of an active self-protection system includes a drive for each of two orthogonal or mutually-perpendicular intersecting axes (elevation and azimuth). The motor for moving the launcher about the traverse axis is usually installed in the fixed lower mount of the launcher, and rotates the movable upper mount of the launcher either directly (direct drive) or indirectly through a gear. However, the motor for moving the launcher about the elevation axis is commonly installed in the rotating upper mount, and moves the launcher tubes either directly (direct drive) or indirectly through a gear. In this configuration, the elevation motor moves with the movable upper mount, and therefore increases the weight and inertia of the movable upper mount about the transverse axis.

One prior art aiming drive is disclosed in EP 1 096 218 B1. In this construction, a launching container is pivotally held on a pivot support that is rotatable around a horizontal axis. A sub-mount arranged below the pivot support accommodates two azimuth actuators and one elevation actuator. The output pinions of the azimuth actuator mesh with a toothed carrier ring at the pivot support, while the elevation actuator acts by means of a support rod and a spindle drive directly on the launching container. Through this, all motors are mounted on the fixed lower mount so that the mass and inertia of the movable upper mount are minimized, and the power available to move the launcher is maximized. However, in such an arrangement, the two axes are coupled such that movement in the traverse direction also creates a disturbance of the launcher's elevation, which has to be compensated for by a further operation of the elevation motor. Furthermore, the range of movement in aiming the launcher is significantly restricted. For example, aiming directly "over head" is not possible.

A follow-up control for an aiming drive is described in FR 982 021 A.

A lateral aiming drive for a combat vehicle with a turret is known from DE 3 736 262 A1.

Accordingly, it would be highly desirable to provide an improved drive mechanism that is adapted to be mounted on a suitable support (e.g., either stationary or vehicular) for controllably moving a first output shaft (e.g., on which a launcher is mounted) about either or both of two orthogonal axes.

DISCLOSURE OF THE INVENTION

With parenthetical reference to the corresponding parts, portions or surfaces of the disclosed embodiments, merely for purposes of illustration and not by way of limitation, the present invention provides an improved drive mechanism (100) adapted to be mounted on a support for controllably moving a first output shaft (16) about either or both of two orthogonal axes (T, E), the drive mechanism having a stationary lower portion adapted to be mounted on the support and having a movable upper portion mounted for movement relative to the stationary portion. The improved drive mechanism broadly includes: a first power train (10, 12, 2, 4, 14) for controllably rotating a first gear (6); a second power train (9, 11, 1, 3,13) for controllably rotating a second gear (5); and a third gear (7) connected to the first output shaft and meshing with at least one of the first and second gears; and wherein the first, second and third gears form a portion of a differential-like mechanism (18) mechanically coupling the first and second power trains to the first output shaft; whereby the first and second power trains may be selectively operated to controllably and cooperatively move the first output shaft to a desired position relative to the support.

The first power train may include at least one first motor (10), a first pinion (2) driven by each first motor, a first intermediate gear (4) driven by each first pinion, and a first shaft (14) coupling the first intermediate gear to the first gear (6).

The second power train may include at least one second motor (9), a second pinion (1) driven by each second motor, a second intermediate gear (3) driven by each second pinion, and a second shaft (13) coupling the second intermediate gear to the second gear (5).

The first and second shafts may be coaxial. One of the first and second shafts may be tubular, and the other of the first and second shafts may be arranged within the one shaft.

The first and second shafts are arranged to rotate about one of the orthogonal axes (T, E).

The drive mechanism may be used to control the elevation and transverse movement(s) of a weapon, and wherein the orthogonal axes may be the elevation and azimuth axes of the weapon.

The support may be stationary or movable, such as a vehicle.

The differential-like mechanism may include a fourth gear (8) meshing with at least one of the first and second gears and mounted for rotation about one of orthogonal axes with the third gear (7).

The third and fourth gears (7, 8) may be in meshing engagement with the first and second gears (6, 5).

A second output shaft (17) may be connected to the fourth gear.

The first and second output shafts (16, 17) may be constrained to rotate together in opposite angular directions.

The first gear (6) may mesh with the fourth gear (8), and the second gear (5) may mesh with the third gear (7).

The first and second gears may have different diameters. The third and fourth gears (7, 8) may be connected to the first output shaft (16).

The first and second output shafts (16, 17) may be arranged to rotate together about the other of the orthogonal axes (E).

Both of the power trains may be operated simultaneously and cooperatively to rotate the first output shaft (17) about either one of, or both of, the orthogonal axes (T, E).

Both of the power trains may be operated simultaneously and cooperatively to rotate the first and second output shafts (16, 17) in opposite directions about either one of, or both of, the orthogonal axes (T, E).

The differential-like mechanism (18) may be mounted on the movable portion, and the motors, pinions and intermediate gears of the first and second power trains may be mounted on the stationary portion to reduce the mass and inertia of the movable portion.

The drive mechanism may further include a supporting member (15) operatively arranged for rotation about one of the orthogonal axes, and wherein the first output shaft (16) is journalled on the member.

Accordingly, the general object of the invention provide an improved drive mechanism that is adapted to be mounted on a suitable support for controllably moving a first output shaft about either or both of two orthogonal axes.

Another object is to provide to improve an improved drive mechanism for quickly aiming a launcher at an incoming projectile or missile.

Still another object is to provide an improved aiming drive of the above-mentioned kind in that the disadvantages of prior art aiming drives are avoided, and an increased alignment efficiency is possible.

These and other objects are satisfied according to the invention in that the first and second power trains as part of a differential-like mechanism are coupled to one another for the combined and cooperative aiming of the weapon in elevation and traverse excursions. Due to the differential-like drive, the power of the first and second power trains can be combined with one another such that an optimal time duration for aiming is achieved, regardless of whether a larger excursion path is to be covered in elevation or traverse. The transmission of power from both power trains for aiming the weapon in elevation only, or in traverse only, is not only possible, but is achieved automatically and without switching. A differential drive can be designed in such a precise manner that compensation movements for compensating the aiming movement in elevation is not compulsory with respect to traverse excursions, and vice versa.

Although the use of a differential-like mechanism in a lateral aiming drive for combat vehicles with a turret is known from DE 3 736 262 A1, this disclosed mechanism only compensates for differences in the drive motors and differences in the drive torques, whereby inhomogeneity in abrasion to the crown gear of the turret can be compensated for, which is produced by out-of-roundness, tooth thickness deviation and pitch defects. The division to two aiming axes extending transversely with respect to one another and their mutual control by the two output power trains, is neither described nor suggested.

In a preferred embodiment, the first power train includes a first output gear as one part of a differential-like mechanism, and the second power train includes a second output gear as part of this same mechanism. A third gear of this mechanism is coupled to the output shaft on which the weapon is mounted. In most cases, this first output shaft is mounted on the upper or movable portion of the improved drive mechanism, and is used for aiming in elevation, while the upper or movable portion is pivotally mounted on the lower or fixed portion to accommodate traversing movements. Preferentially, the third gear, or possibly even a fourth gear, is connected between the differential-like mechanism and the weapon shaft so that a direct effect on the weapon takes place. The behavior of the differential-like mechanism can be purposefully determined by the design, particularly as to pitch diameter, number of teeth, and the speed and direction of movement of the first drive gear, the second drive gear, and the effect thereof on the weapon shaft.

An arrangement seems to be most favorable in which the first and the second gears are rotatably supported coaxially around the traverse axis, and the differential-lie mechanism is rotatably supported together with the weapon shaft coaxially around the elevation axis. Hence, the first and second output gears must merely rotated around the traverse axis. However, a movement in elevation is not required so that preferably masses must be moved for aiming the weapon.

To facilitate the entire structure and to preferably avoid the need for additional gears, it is provided in a variant that the first power train comprises at least one first motor controllable in speed and direction, and the second power train comprises at least one second motor that is also controllable in speed direction. Synchronous motors may be used. By the interaction of the motors in the first power train and the motors in the second power train, a power division caused by different speeds and different directions of rotation can be achieved. Hence, the power of the first motor(s) and the power of the second motor(s) can be completely transferred to an aiming movement in traverse, when a movement in elevation does not take place, or vice versa. Compared to conventional aiming drives with an identical motor speed, the drive power available for one of the directions of movement can in the most favorable case be doubled.

The first and second motors are preferably arranged on the lower or fixed portion of the drive mechanism. A fixed socket or recess in the vehicle to receive the fixed lower portion of the drive mechanism is conceivable. The motors and essential parts of the drive train can then be arranged in the fixed socket or recess.

In a further embodiment, it is provided that each first motor has a first drive pinion that meshingly engages the outer circumference of a first intermediate gear arranged coaxially with respect to the first output gear, and each second motor has a drive pinion meshing at the outer circumference with a second intermediate gear arranged coaxially with respect to the second output gear, wherein the first output gear and the first intermediate gear are arranged on a drive shaft arranged coaxially with respect to the traverse axis, the second output gear and the second intermediate gear are arranged on a hollow shaft arranged coaxially with respect to the traverse axis, and the drive shaft extends through the hollow shaft. Through this, a vertical guide of the two power trains in parallel connection with a possible compact structure is achieved. Caused by the arrangement of individual elements coaxially with respect to the traverse axis, the masses to be moved for the aiming movement are reduced.

Furthermore, a supporting member rotatably supported around the traverse axis can be provided to journal the weapon shaft and the third gear around the elevation axis. Compared to conventional aiming drives with an identical amount of motors, the drive power available can be doubled in the ideal case for one of the directions of movement.

An especially simple variant provides that the first and the second power train have the same transmission ratio. Through this, identical drive motors can also be used and the respective control is simplified.

The third gear may preferably mesh with the first as well as with the second output gear. This is a conventional simple differential. The first and the second output gear preferably have the same number of teeth. If the first and the second output gears rotate in the same angular direction at the same angular speed, there is no movement about the elevation axis, and the weapon carries out one aiming movement in the traverse axis only. If the first and the second output gears rotate in opposite angular direction at the same angular speed, there is no movement about the traverse axis, and the weapon carries out one aiming movement in the elevation axis only. In all other combinations of angular speed and angular direction of the two output gears, a precisely-defined compound motion occurs, and the weapon simultaneously carries out an aiming movement by rotation about both the elevation and the traverse axes.

In a further embodiment, it is provided that a plurality of gears, preferably two, are provided in the differential-like mechanism. These gears can then drive different weapon shafts so that for instance several launching tubes can be moved. In a further embodiment, in which the third and fourth gears mesh with the first and the second output gears, the weapon shafts always move in opposite direction. If a launching tube is mounted on each shaft, the entire upper hemisphere can be covered with only 90° rotary motion in elevation and 90° rotary motion in traverse. For this purpose, the third and fourth gears in the differential-like mechanism can be coupled with its own weapon shaft.

A further embodiment provides that two gears in the differential-like mechanism arranged coaxially with respect to one another are provided which are coupled with a mutual weapon shaft, and, the third gear meshes with the first output gear, and the fourth gear meshes with the second output gear. In such an embodiment, a launching tube can, for instance, be mounted at each end of the weapon shaft. The launching tubes always rotate in the same angular direction. Caused by the mutual arrangement of the output gears on the weapon shaft, an occurrence of falling axial forces can substantially be avoided particularly when using bevel gears.

The invention will now be explained by means of the drawings.

DESCRIPTION OF THE PREFERRED EMBODIMENTS

Figure 1:
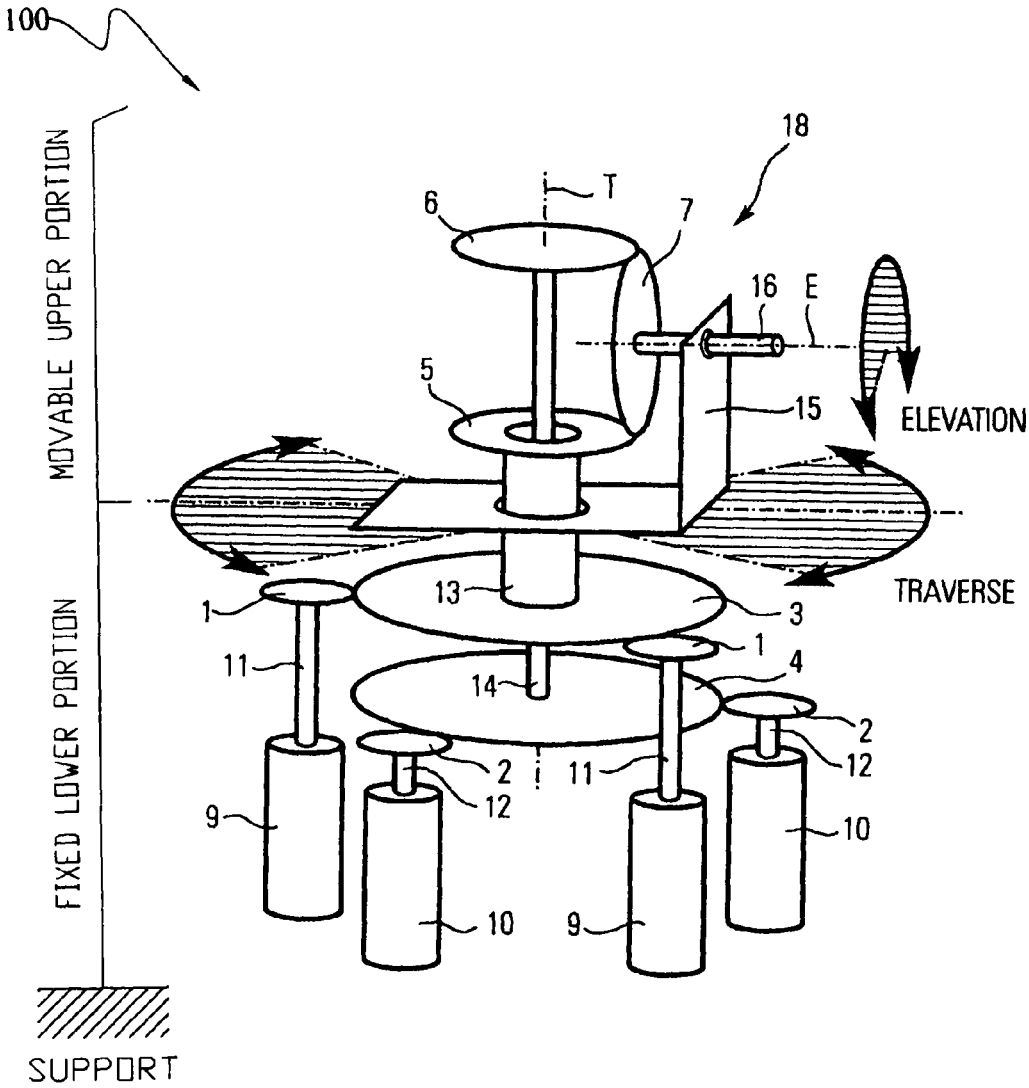
FIG. 1 is a perspective schematic view of a first embodiment of the improved drive mechanism.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The invention will now be described in the environment of a vehicle-mounted aiming device for directing counter-fire from a launcher toward an incoming projectile or missile. The launcher basically includes a fixed lower mount and a movable upper mount on which one or a plurality of launching tubes for defense grenades are rotatably arranged in two axes. This basic structure of grenade launchers is known so that only the new and inventive drive mechanism will be discussed below.

Referring now to FIG. 1, a first form of the improved drive mechanism is generally indicated at 100. The aiming drive shown comprises two drive trains. The first drive train comprises two electro-motors 10, of which the angular speed and direction of angular rotation can be controlled. The electro-motors have a shaft that can be made to rotate in either of two angular directions (i.e., clockwise and counterclockwise. These electro-motors are both arranged in the non-movable lower part of the grenade launcher. The motors 10 each have a drive shaft 12 and a pinion drive gear 2 attached thereto. The first electro-motors 10 are arranged arcuately at 120° with respect to each other around the vertical traverse axis T. The number of teeth (Z2) of each drive gear 2 is identical. The intermediate gear 4 rotates around the traverse axis T, and has a drive shaft 14 that extends from intermediate gear 4 in the lower mount of the grenade launcher upwardly into the upper mount. The drive shaft 14 is coaxial with respect to the traverse axis T. A first output gear 6 is arranged at the upper end of the drive shaft 14.

The second drive train comprises two electro-motors 9, of which the angular speed and direction of angular rotation can be controlled. These two electro-motors are both arranged in the fixed lower part of the grenade launcher. Each of electro-motors 9 has a drive shaft 11 and a drive gear 1. The second electro-motors 9 are arcuately arranged around the traverse axis T. The drive gears 1 have the same number of teeth (Z1), and mesh with the intermediate gear 3. The intermediate gear 3 is arranged at the lower end of a hollow shaft 13 that extends upwardly from intermediate gear 3 and coaxially with respect to the traverse axis. A second output gear 5 is arranged at the upper end of the hollow shaft 13.

The first shaft 14 extends upwardly through the hollow shaft 13 so that that intermediate gears 4 and 3, as well as the output gears 5 and 6, rotate around the vertical traverse axis T. The number of teeth (Z5, Z6) on the first and the second output gears 6, 5 is identical.

The functional separation into lower fixed mount and the rotary upper mount is implemented in that the transition between the socket and the upper mount of the grenade launcher is approximately in the area of the hollow shaft 13 so that motors 9, 9, 10, 10, their output shafts 12, 11, pinions 1, 2, and intermediate gears 3, 4 are all arranged in the lower mount.

The first and second output gears 6, 5 are part of a differential-like mechanism drive 18. A third gear 7, with the number of Z7 teeth, meshes with the first and the second output gears 6, 5, and rotates about horizontal elevation axis E. A weapon-carrying first output shaft 16 has its left end fixed to third gear 7. The weapon shaft extends along the elevation axis E, and is rotatably supported in a supporting member 15 that is mounted for rotation about traverse axis T. At least one launching tube (not shown) is mounted on weapon shaft 16. This launching tube rotates with the supporting member 15 around the vertical traverse axis T to control the horizontal traverse of the launching tube, and rotates with shaft 16 about elevation axis E to control the elevation of the launching tube.

The mode of operation of the above-described aiming drive will now be explained in detail.

The aiming drive shown is part of an active self-protection system which especially serves for the protection of armored vehicles against guided missiles, ammunition of heavy guns, and so-called RPGs. Incoming projectiles are detected and tracked by a fast reacting sensor suite (not shown), that includes a suitable search and tracking radar, and are destroyed close to the vehicle by fragmentation grenades. In order to do so a defense grenade is fired from a lightweight launcher that can be aimed extremely quickly by controlled rotation about the elevation axis E and the traverse axis T in the direction of the incoming projectile, and is subsequently exploded so that the projectile is neutralized at a safe distance away from the vehicle. The sensor suite controls the operation of electro-motors 9 and 10. Depending on the initial orientation of the launching tube, this tube must be moved quickly about the traverse and/or elevation axes when an incoming projectile or missile is detected. The first electro-motors 10 are controlled synchronously so that they drive the drive shaft 14 with the same angular direction and speed by interconnection of the intermediate gear 4. The same applies to the second electro-motors 9, which synchronously drive the hollow shaft 13 with the same angular direction and the same angular speed by interconnection of the intermediate gear 3. Because of the arcuately-spaced arrangement of the motors 9, 10 around a intermediate gears 3, 4, respectively, a plurality of small motors with a small diameter can be used. That means a high power density at low moment of inertia.

Depending on the angular speed and angular direction of the drive gears (5 or 6), the launching tube (or the launching tubes) can be moved either simultaneously or independently of one another about the traverse axis T and in the elevation axis E.

If the output gears 5, 6 rotate at the same speed, the weapon shaft 16 does not rotate (i.e., there is no aiming movement in elevation) and the launching tube in the upper mount carries out an aiming direction around the traverse axis caused by a rotary movement of the supporting member 15.

In all other combinations of angular speed and angular direction of the two output gears 5, 6, a superposition of the rotary movements results, and the launching tube (or the launching tubes) in the upper mount simultaneously carry out an aiming movement in both directions. The power provided by the first and the second power train is therefore distributed, depending on the control of the first and second electro-motors 9 and 10, into compound movement of first output shaft 16 about the traverse axis T and the elevation axis E, which in the extreme case means that the combined power of both power trains is fully available for the aiming in one of the two axes. Because of the combined interaction, the control of the first and second electromotors 9 and 10 can be implemented such that the time for adjusting the launching tube, if a compound movement is to be made, is equally long for the movements about both axes. A greater power is then available for the larger movement path.

The following advantages can be achieved:

The aiming drive is composed of two equivalent drive axes mechanically coupled with a differential-like mechanism, power of which can be distributed in any manner to cause movement about the elevation and traverse axes. It is also possible to concentrate the summed drive power of both drive axes onto the elevation axis only, while the traverse axis stands still. Conversely, it is possible to concentrate the summed drive power of both drive axes to the traverse axis only, while the elevation axis stands still.

All drive motors are fixedly arranged in the fixed lower part so that the moved masses and inertia in the movable upper mount can be kept small.

One motor or several motors can be used in each drive axis, the pinions of the motors meshing with a mutual gear for summing the power.

Because of the circular arrangement of the motors around the common gear, a plurality of small motors with a small diameter can be used. This means a high power density at a low momentum of inertia.

The circular arrangement of the motors leaves space in its center directly in the traverse axis, for example, for a collector ring to conduct the electric firing signals from the fixed lower part upwardly into the movable upper mount of the launcher. For this purpose the shaft 14 may be a hollow shaft.

The elevation and the traverse axis can both rotate in principle n×360°. Depending on the attachment and adjustment of the launching tubes on the elevation axis, small angles of rotation are required to reach any target in the entire upper hemisphere.

Figure 2:
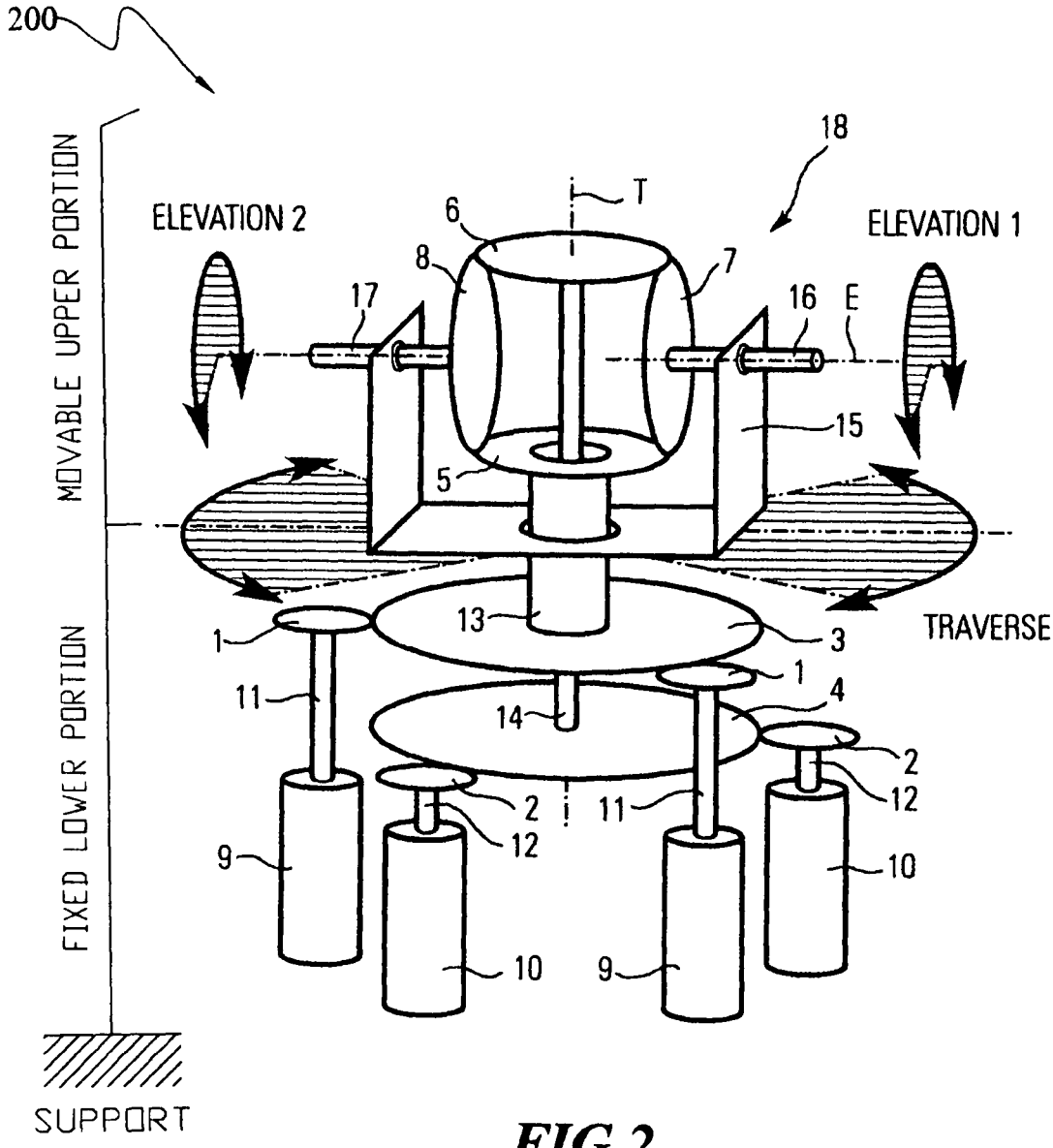
FIG. 2 is a perspective schematic view of a second embodiment of the improved drive mechanism.

A second embodiment of the present invention, generally indicated at 200, will now be explained in detail by means of FIG. 2. Only the essential differences to the preceding embodiment will be explained. Thus, the same reference numerals are used for identical components or components having the same function, and in this respect, reference is made to the preceding description.

The differential-like mechanism 18 has a fourth gear 8 in the upper mount (number of teeth 28) with a further weapon shaft 17. The drive gears 5, 6, as well as the third and fourth gears 7 and 8, are advantageously designed as toothed bevel gears with gears 5, 6 having the same number of teeth, and gears 7, 8 having the same number of teeth. The supporting member 15 is modified so that it simultaneously supports the first and the second weapon shaft 16 and 17.

In this arrangement the weapon shafts 16 and 17 always rotate in opposite angular directions. If at least one launching tube is mounted on each of these weapon shafts 16 and 17, the entire upper hemisphere can be covered with only 90° rotary movement in elevation and 90° rotary movement in traverse.

Figure 3:
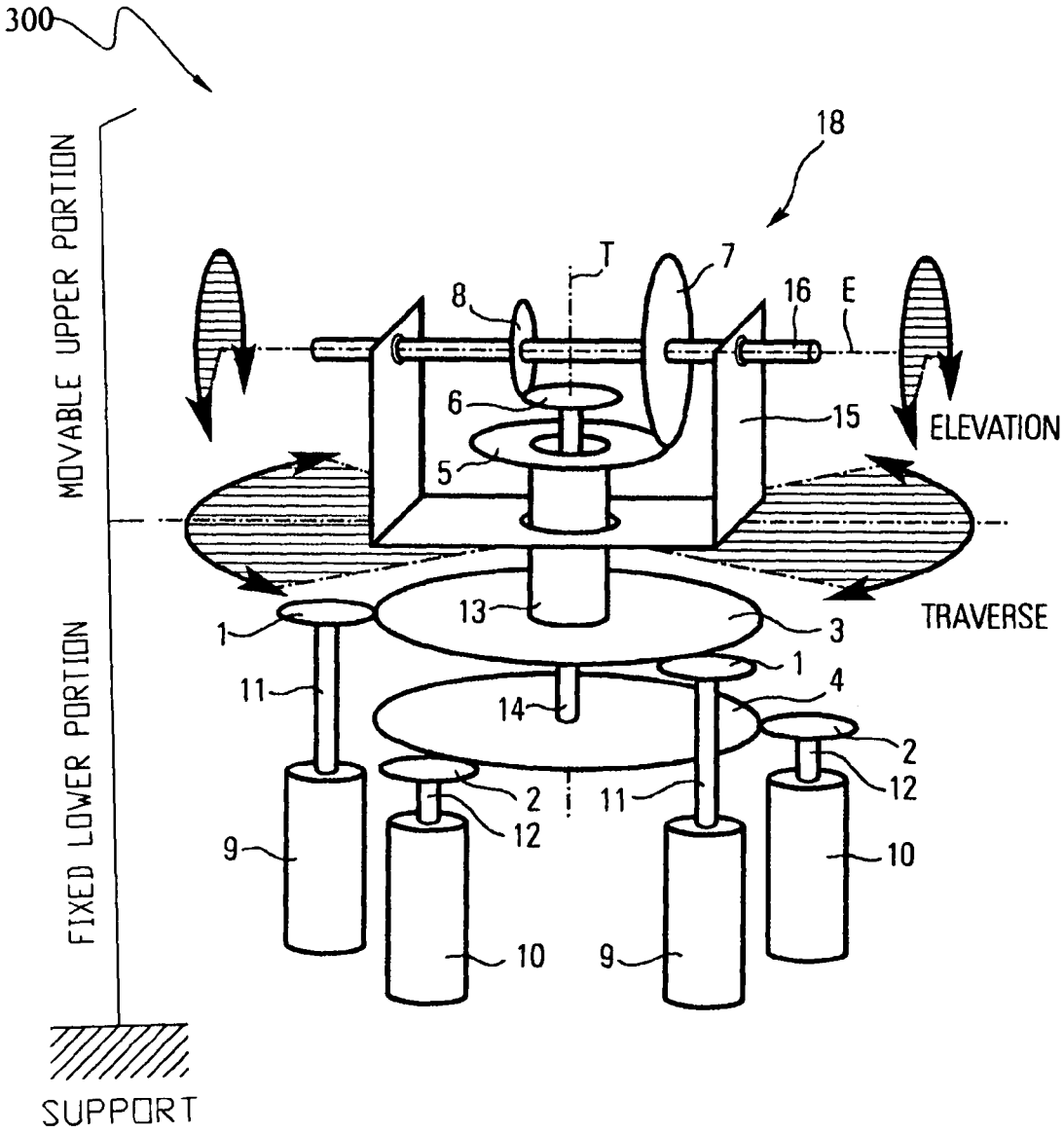
FIG. 3 is a perspective schematic view of a third embodiment of the improved drive mechanism.

A third embodiment of the invention, generally indicated at 300, will now be explained in detail by means of FIG. 3. Only the essential differences to the preceding embodiment will be explained. Thus, the same reference numerals are used for identical components or components having the same function, and in this respect, reference is made to the preceding description.

The differential-like mechanism 18 in the upper mount again has two gears 5, 6, 7 and 8 and a continuous weapon shaft 16 that connects the differential gears 7 and 8 with one another. The output gear gears 5 and 6 as well as the differential gears 8 and 7 are distributed with respect to their number of teeth such that these toothed bevel gears have a transmission ratio Z5/Z7=Z6/Z8, where Z is the number of teeth.

In this arrangement, at least one launching tube can be mounted at each end of the weapon shaft. These launching tubes always move in the same angular direction. The support of the weapon shaft is free from axial forces, which are introduced by the movement of the bevel gear pairs, 5, 7 and 6, 8.

Modifications

The present invention expressly contemplates that many changes and modifications may be made.

For example, the weapon may be a grenade launcher, a Gatling gun, or some other defensive weapon system. The motors may be synchronous electrical motors. However, other types of motors may be substituted therefor. The differential-like mechanism may take many different forms. In some cases, this mechanism may be an actual differential, such as shown in FIG. 2. In other cases, this mechanism may simulate a differential-like motion, as shown in FIGS. 1 and 3. This mechanism may take other forms as well. Indeed, the improved drive mechanism is not limited to the disclosed end use, but has a general utility.

Therefore, while three presently-preferred forms of the improved drive mechanism have been shown and described, and certain changes thereof discussed, persons skilled in this art will readily appreciate that various additional changes and modifications may be made without departing from the spirit of the invention, as defined and differentiated by the following claims.

What is claimed is:

1. A drive mechanism adapted to be mounted on a support for controllably moving a first output shaft about either or both of two orthogonal axes, said drive mechanism having a stationary portion adapted to be mounted on said support and having a movable portion mounted for movement relative to said stationary portion, said drive mechanism comprising:

a first power train for controllably rotating a first gear;

a second power train for controllably rotating a second gear; and a third gear connected to said first output shaft and meshing with at least one of said first and second gears; and wherein said first, second and third gears form a portion of a differential-like mechanism mechanically coupling said first and second power trains to said first output shaft such that said power trains may be selectively and simultaneously operated so that the rotational movements of said first and second gears may be combined to cause movement of said first output shaft about either or both of said axes;

whereby said first output shaft may be moved to a desired position relative to said support.

2. A drive mechanism as set forth in claim 1 wherein said first power train includes at least one first motor, a first pinion driven by each first motor, a first intermediate gear driven by each first pinion, and a first shaft coupling said first intermediate gear to said first gear

3. A drive mechanism as set forth in claim 2 wherein said second power train includes at least one second motor, a second pinion driven by each second motor, a second intermediate gear driven by each second pinion, and a second shaft coupling said second intermediate gear to said second gear.

4. A drive mechanism as set forth in claim 3 wherein said first and second shafts are coaxial.

5. A drive mechanism as set forth in claim 4 wherein one of said first and second shafts is tubular, and the other of said first and second shafts is arranged within said one shaft.

6. A drive mechanism as set forth in claim 4 wherein said first and second shafts are arranged to rotate about one of said orthogonal axes.

7. A drive mechanism as set forth in claim 3 wherein said differential-like mechanism is mounted on said movable portion, and wherein the motors, pinions and intermediate gears of said first and second power trains are mounted on said stationary portion to reduce the mass of said movable portion.

8. A drive mechanism as set forth in claim 1 wherein said drive mechanism is used to control the elevation and traverse movement of a weapon, and wherein said orthogonal axes are the elevation and azimuth axes of said weapon.

9. A drive mechanism as set forth in claim 1 support is a vehicle.

10. A drive mechanism as set forth in claim 1 wherein said differential-like mechanism includes a fourth gear meshing with at least one of said first and second gears and mounted for rotation about one of said orthogonal axes with said third gear.

11. A drive mechanism as set forth in claim 10 wherein said third and fourth gears are in meshing engagement with said first and second gears, respectively.

12. A drive mechanism as set forth in claim 11 and further comprising a second output shaft connected to said fourth gear.

13. A drive mechanism as set forth in claim 12 wherein said first and second output shafts are constrained to rotate together in opposite angular directions.

14. A drive mechanism as set forth in claim 12 wherein said first and second output shafts are arranged to rotate together about the other of said orthogonal axes.

15. A drive mechanism as set forth in claim 10 wherein said first gear meshes with said third gear, and said second gear meshes with said fourth gear.

16. A drive mechanism as set forth in claim 15 wherein said first and second gears have different diameters.

17. A drive mechanism as set forth in claim 16 wherein said third and fourth gears are connected to said first output shaft.

18. A drive mechanism as set forth in claim 1 and further comprising a member operatively arranged for rotation about one of said orthogonal axes, and wherein said first output shaft is journalled on said member.

* * * * *